US005746625A

United States Patent [19]

Aparicio et al.

[11] Patent Number: 5,746,625

[45] Date of Patent: May 5, 1998

[54] DEVICE TO JOIN UP CABLE SHEATHINGS

[75] Inventors: Jean-Pierre Aparicio, Velizy; Christian Douchin, Montrouge, both of France

[73] Assignee: Thomson-CSF, Paris, France

[21] Appl. No.: 633,357

[22] Filed: Apr. 17, 1996

[30] Foreign Application Priority Data

Apr. 21, 1995 [FR] France ..... 95 04819

[51] Int. Cl.[6] ..... H01R 9/03

[52] U.S. Cl. ..... 439/610; 439/905

[58] Field of Search ..... 439/610, 607, 439/608, 609, 461, 462, 470, 471, 472, 98, 583, 311, 904, 905

[56] References Cited

U.S. PATENT DOCUMENTS

| | | | |
|---|---|---|---|
| Re. 31,995 | 10/1985 | Ball | 439/610 |
| 3,732,526 | 5/1973 | Punako | 439/471 |
| 3,891,294 | 6/1975 | Philibert | 439/462 |
| 4,810,210 | 3/1989 | Komatsu | 439/610 |
| 5,246,376 | 9/1993 | Schuhl et al. | 439/98 |

FOREIGN PATENT DOCUMENTS

| | | | |
|---|---|---|---|
| 40 13 963 | 10/1991 | Germany . | |
| 0571835 | 9/1943 | United Kingdom | 439/470 |
| 2 060 278 | 4/1981 | United Kingdom . | |

*Primary Examiner*—Neil Abrams
*Assistant Examiner*—Tho D. Ta
*Attorney, Agent, or Firm*—Oblon, Spivak, McClelland, Maier & Neustadt, P.C.

[57] ABSTRACT

A device to join up cable sheathings comprises a chamber and a shaft. The shaft houses the cable and is connected in an electromagnetically impervious way to a rear part of the chamber. A front part of the chamber is itself designed to be connected in an electromagnetically impervious way to a casing, for example a connector casing. The conductive surface providing for the impervious electrical continuity between the periphery of the shaft and periphery of the chamber is outside the chamber. This makes it possible to give the internal diameter of the shaft a value that is substantially equal to that of a casing to which the front part of the chamber must be connected.

12 Claims, 4 Drawing Sheets

DEVICE TO JOIN UP CABLE SHEATHINGS

BACKGROUND OF THE INVENTION

1. Field of the Invention

The invention pertains to the field of devices used to join up the sheathing of cables.

Devices of this kind are used to connect a cable or a strand of sheathed cables, for example to an electrical connector or more generally to a pack into which there penetrates at least a part of the cables forming the strand.

2. Description of the Prior Art

The prior art that is most closely related to the invention is described in the patent DE 4 013 963.

FIG. 1 of this patent is reproduced and is the object of FIG. 1 of the present application.

The device of FIG. 1 has a symmetry of revolution about a longitudinal axis XX'. This longitudinal axis enables the defining of a front part of the device located, in this example, to the right of the figure and a rear part located, in this example, to the left of the figure. The front part is the connection part of the cable or strand of cables. It corresponds to an end of the cable that has to be connected to a connector or a pack. It is the lead-out end of the cable. The rear end of the device is the lead-in end of the cable or strand of cables.

The device shown in FIG. 1 essentially has the following elements, seen from the lead-out end of the cable to its lead-in end, namely from the right to the left of the Figure: a metal chamber 11, a shaft or passage 17 and a nut 25 to connect the chamber 11 and the shaft 17. In FIG. 1, only a rear part of the chamber 11 is shown.

This device shall now be explained with reference to the aim being pursued.

The aim of the device essentially is to enclose the lead-out end of the cables within a chamber, namely the chamber 11, this chamber being made electromagnetically impervious or sealed.

For this purpose, the lead-out end of the chamber (not shown in FIG. 1) is fitted out with connecting means enabling the electromagnetically impervious connection of the chamber for example to a connector or to a pack. The rear end of the chamber is fitted out with means to make the rear end of the device electromagnetically impervious. The rear end of the metal chamber has a recessed wall 13. This wall has an aperture 15. Since the rear part of the metal chamber 11 is a hollow cylinder, the diameter of the aperture 15 is smaller than the internal diameter of the chamber. The shaft is cylindrical. Its external diameter is smaller than the diameter of the aperture 15 made in the wall 13 so that the shaft can slide in the chamber 11.

To make the rear part of the chamber 11 electromagnetically impervious, the shaft is provided with a shoulder 23, the external diameter of which is smaller than the internal diameter of the chamber 11 but greater than the diameter of the aperture 15 of the rear wall 13 of the chamber 11. It follows therefrom that the shaft 17 must be inserted into the chamber 11 through the front end of this chamber. The shaft may then slide towards the rear of the chamber until the shoulder 23 comes into contact with the rear wall 13 of the chamber 11. At this time, an external thread 21 of the shaft is outside the chamber. The nut 25, once it is tightened on this thread 21, holds the shoulder 23 against the wall 13 thus providing for the electromagnetic sealing of the rear part of the chamber 11.

Although it is being distributed commercially and is satisfactory, this type of device has two major drawbacks.

The devices used to join up sheathings are often used for the electromagnetically impervious introduction of the ends of the cables in a strand of cables into an electromagnetically impervious casing of a sheathed connector. In general, this sheathing casing of the connector ends in its rear in a threaded part enabling the connection with the chamber of the device for joining up the sheathings. The result thereof is that the internal diameter at the front part of the connection chamber of the device used to join up sheathings is determined by the value of the connection diameter of the rear part of the casing of the connector. The shoulder 23 of the shaft which has to penetrate the chamber through this front part of the chamber must necessarily have an external diameter that is smaller or at least equal, allowing for tolerances, to the internal diameter of this front part of the chamber. The result thereof is that at least a part of the shaft in the vicinity of the shoulder 23 has a diameter that is smaller than that of the shoulder 23 and is therefore in principle smaller than the diameter of the connection casing of the connector. This connection casing of the connector has an internal diameter that enables the tight passage of the n cables of the connector. The result thereof is that, often, the use of a sheathing device of the type described in FIG. 1 of the patent referred to can be envisaged only for a strand of cables having only a number $n_1$ of cables, this number $n_1$ being smaller than the number of cables permitted by the connector.

In short, the first drawback of the device as described in FIG. 1 of the patent referred to arises out of the fact that the part of the shaft having the smallest internal diameter does not permit the passage of the n cables that could be connected to the connector.

The second drawback too results from the mode of introduction of the shaft into the chamber of the connection device. Since the shaft is inserted by the front, the use of a device as described in this patent becomes difficult when the connection chamber of the device is elbowed. In this case, the length of the diagonal line of the elbow determines the maximum length of the shaft. In most cases, the shaft, as shown in FIG. 3 of the above-mentioned patent, has an extension in front of the shoulder 23. This FIG. 3 is shown in FIG. 2 of the appended drawings. This figure shows a lateral view of a shaft 17 mounted on a cable 29. A front end 35 of the shaft 17 is used as a ground contact. The metal casings of each of the cables of the strand are folded down over this part 35 in a known way. A fastening ring 39 holds the folded-down parts 37 of the cable-sheathing metal casings clamped against the part 35. In such a case, the length of the shaft is an addition of lengths comprising at least the length of the part 35 on which the metal casings of the cables are folded down, the length of the shoulder 23 and the length of the shaft part 21 external to the chamber 11.

SUMMARY OF THE INVENTION

The present invention proposes to overcome these drawbacks. It also proposes a device to join up the sheathing of cables, making it easier to set up the cables than in the prior art, especially for elbowed connections. It is aimed finally at obtaining a device to join up cable sheathings that does not substantially increase the amount of space required in the vicinity of the end of the cable, and that therefore has a reasonable mass and is simple to manufacture.

It has been explained further above that the problem of the limitation of the number of cables that can be made to pass into the shaft is due to the internal diameter of the shaft which, according to the prior art, is necessarily smaller than the diameter of connection of the chamber to the casing for the sealing of the connector. The difference in diameter arises essentially out of the difference between the external diameter of the shoulder 23 and the diameter of the aperture 15. This is why, according to the invention, the shoulder of the shaft has an external diameter greater than the internal diameter of the rear end of the chamber or smaller than the internal diameter of a connection made of one or more parts between the chamber and the shoulder. As a result, the shaft gets threaded into the chamber no longer by the front but by the rear. What is important, in order to ensure the rear sealing, is that a continuous surface of conductive material must be in contact, firstly throughout the periphery of the shaft and, secondly, throughout the periphery of the chamber. It may be a surface formed by a flexible material, for example bound to each of the parts. For reasons of mechanical behavior and positioning of the shaft with respect to the chamber, the conductive surface is generally formed by a shoulder in electrical contact with the periphery of the shaft and with the periphery of the chamber. It is not necessary for the chamber or the shoulder to have an external circular perimeter. It will be noted however that, for obvious reasons of simplicity of manufacture, this shape is the most common one. In brief, the invention pertains to a device designed to provide for the sheathing of the ends of a strand of sheathed cables, these ends having to be inserted into a sheathing casing, the device comprising a chamber having, along an axial line XX' of the device, two ends, one front end close to the ends of the cables and one rear end at a distance from these ends, an internal surface of the chamber demarcating an internal volume of the chamber, a shaft at least a part of which is located outside the chamber in the vicinity of its rear end, the shaft comprising an internal surface and an external surface, the internal surface of the shaft demarcating a volume designed to house a part of the strand, the shaft having, along the axial line XX' of the device, two ends, one front end close to the ends of the cable and one rear end at a distance, the electromagnetic imperviousness at the rear end of the chamber being ensured by means that are in continuous electrical contact firstly throughout the periphery of the shaft and secondly throughout the periphery of the chamber, wherein the means of contact between the shaft and the chamber together form an element, of which the external perimeter of at least one cross-section along a plane locally perpendicular to the axial plane of the device has a perimeter greater than the internal perimeter of a cross-section of the chamber along this same plane.

In the device described in the patent application DE 4 013 963, the means providing for the contact between the shaft and the chamber are formed by the shoulder 23. This shoulder is, in this case, a part of the shaft 17. The diameter of the shoulder is smaller than the internal diameter of the chamber 11. A cross-section of the shoulder along a plane perpendicular to the axis of the shaft and of the chamber has an external circular shape. The external perimeter of the shoulder is at most equal to the perimeter of the cross-section of the chamber since the shoulder 23 is housed in the chamber.

In a first embodiment of the invention, the contact means are also constituted by a shoulder of the shaft. The condition laid down in order that this shoulder may have an external perimeter cross-section greater than the internal perimeter of the cross-section of the chamber is that this shoulder should be outside the chamber.

As a result, the external diameter of the shaft may be equal, allowing for tolerances, to the internal diameter of the chamber. This will be enough, in most cases, for the number of cables entering the sheathing device to be equal to the number of cables permissible on the sheathed connector.

It may also be noted that the shaft, owing to its novel architecture, is introduced, in this embodiment, into the chamber by its second end, namely it is located on the cable side. In the event of an elbowed chamber, it is then not necessary for the shaft to cross the elbow. The elbow does not need to be crossed except by the flexible part of the cable. This greatly facilitates the assembly.

In the preferred embodiment, the contact means are formed by at least two sector shells, these sector shells being in contact firstly with a sector of the periphery of the shaft and secondly with a sector of the chamber. When they are assembled, the sector shells provide for contact between the periphery of the shaft and the periphery of the chamber. The advantage procured by the use of these shells arises out of the fact that the shaft may be introduced, in the absence of these shells, more deeply into the chamber or, in other words, the chamber may be moved away further behind the cable. In the event of action on a connector already mounted, the chamber may be moved away towards the cable and the work space comprising the connector and the end of the cable is well cleared.

BRIEF DESCRIPTION OF THE DRAWINGS

The preferred embodiment of the invention and of the variants shall now be described with reference to the appended drawings, of which:

FIGS. 3 to 8 show the preferred embodiment and a variant of the invention;

FIG. 3 shows a sectional half-view along an axial plane and a lateral half-view of an exemplary chamber of a device for joining up sheathings according to the invention;

FIG. 4 shows a sectional half-view along an axial plane and a lateral half-view of a shaft of a device for joining up sheathings according to the invention;

FIG. 5 comprises FIGS. 5*a* and 5*b;*

FIG. 6 shows a sectional half-view along an axial plane and a lateral half-view of a nut designed to hold the shaft and the chamber in assembled condition;

FIG. 7 comprises FIGS. 7*a* and 7*b;*

FIG. 8 shows a sectional half-view along an axial plane and a lateral half-view of an exemplary device assembled according to the invention.

MORE DETAILED DESCRIPTION

Figure 1:
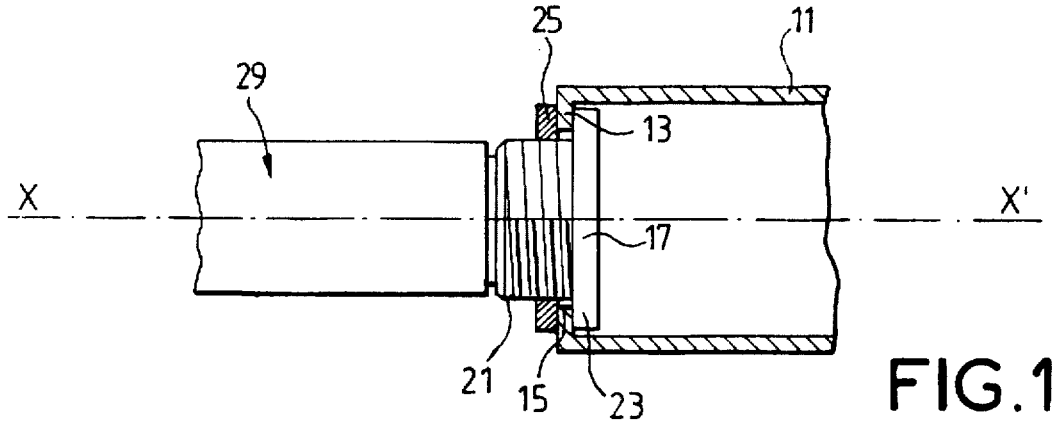
FIG.1 PRIOR ART
FIGS. 1 and 2, already described, respectively represent the rear part of a device for joining up cable sheathings and an exemplary embodiment of a shaft according to the prior art.
Figure 2:
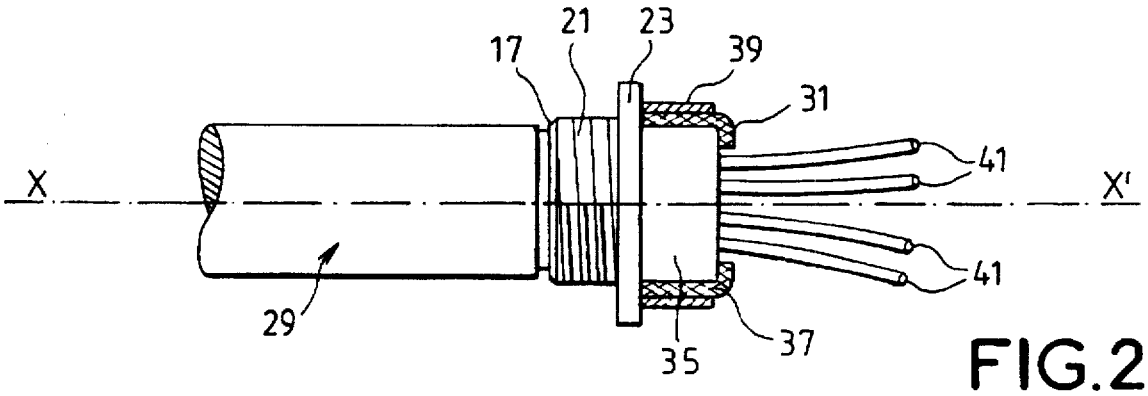
FIG.2 PRIOR ART

In the following description, in order to facilitate the comparison with the nearest examples of the prior art as shown in FIGS. 1 and 2, the parts having the same functions as in the prior art bear the same numbers.

Figure 3:
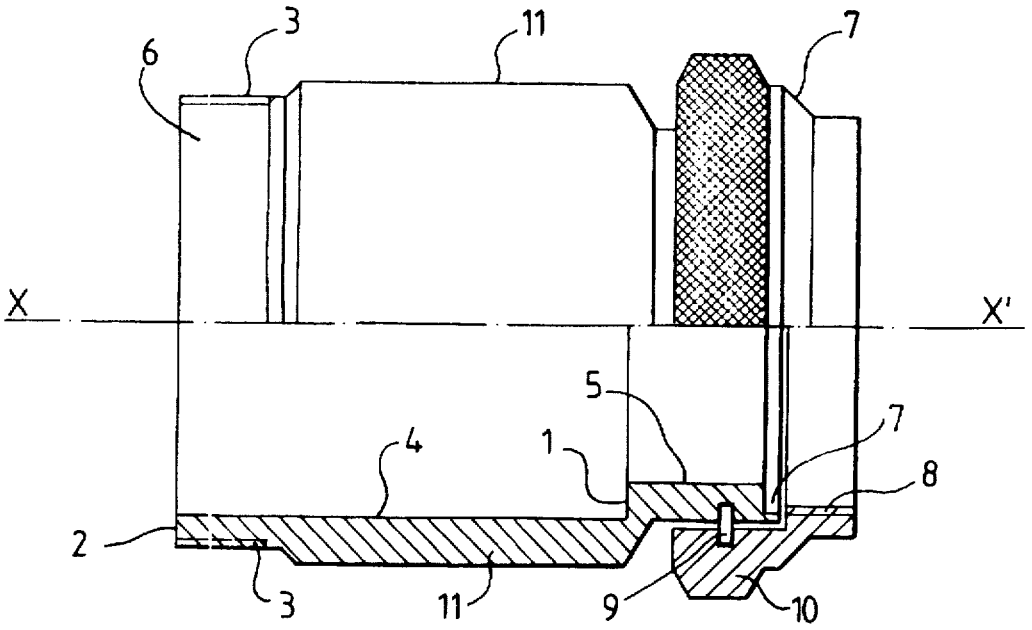

FIG. 3, in its lower part, represents a sectional half-view, along an axial plane, of a chamber 11. In its upper part, this figure shows a lateral half-view of this same chamber.

The chamber 11 shown in FIG. 3 has a shape generated by revolution about a longitudinal axis XX'. In this figure, for purposes of information, a nut 10 has been added. This nut 10 is attached to the chamber 11 in a known way by means of a circlip 9. The nut 10 which is rotationally movable on the chamber 11 enables the impervious connection of the chamber to a pack or to a sheathed connector casing. In the latter case, a thread 8 of the nut has the standardized dimensions laid down as a function of the number of pins of the connector and of the diameter of these pins. The chamber 11 has two ends. There is a first end 7 forming the lead-out end or front end of the chamber. A second end 6 forms the lead-in end or rear end of the chamber. The chamber 11 has a front part 5 and a rear part 4.

Figure 8:
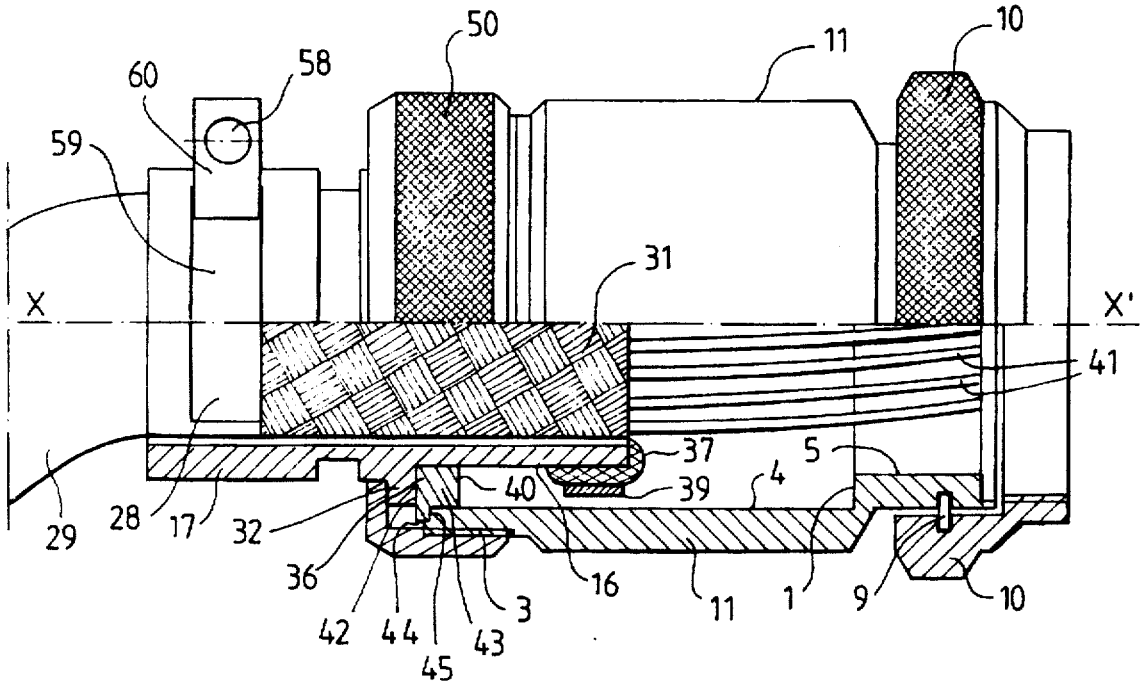

In the example shown, the front part 5 has an internal diameter that is smaller than the diameter of the rear part 4. The diameter of the part 5 has dimensions close to that of the internal diameter of the connector casing of the pack or the connector to which the cable has to be connected. In general, in this front part 5, a protection sheath for the entire strand and/or sheaths for the protection of each of the cables have been removed. The result of this is that the section needed for the passage of the cables is smaller here than it is further behind where various protection systems are still present. The diameter of the rear section 4 is greater for it must enable the housing of the shaft which itself houses the cable. An examination of the drawing of the overall assembly of the preferred exemplary embodiment which shall be described further below with reference to FIG. 8 shows that, in this example, the internal diameter of the shaft is slightly smaller than the diameter of the front part 5. This is due to the fact that, in the particular case of this exemplary embodiment, because of the protection of the cables used, there has been no difficulty in obtaining the passage of the cable with these dimensions. It will be noted however that, in the event of difficulties of this nature, it is possible to increase the difference in diameter between the front part 5 and the rear part 4 of the chamber 11. In this case, there is no difficulty in making a shaft whose internal diameter has dimensions close to that of the smaller diameter of the chamber 11.

Nor is there any difficulty in making a space within the chamber 11. Said space enables, for example the housing of a front part 35 of the shaft, the overall external diameter of which, once the cable is mounted, is increased by the thickness of the folded-down part 37 and generally by a fastening ring 39. In the example shown, the internal surface of the chamber 11 has only two values of diameter, one for the front part 5 and one for the rear part 4. These two surfaces are connected by a connection surface 1. If conditions of external space requirement made it necessary for the dimensions of the parts housed in the chamber to be followed more strictly, it would be possible to design a further recessing of the internal surface to enable smaller diameters of the external surface. If, on the contrary, there are no constraints related to space requirement, the front and rear parts 5 and 4 could have the same diameter.

A rear external part 3 of the chamber 11 is threaded. The thickness of the externally threaded tube forming the rear part of the chamber 11 forms, at its rear end 6, a ring-shaped surface 2 whose internal diameter is the internal diameter of the rear end 6 of the chamber 11 and whose external diameter is the external diameter of the rear end 6.

Figure 4:
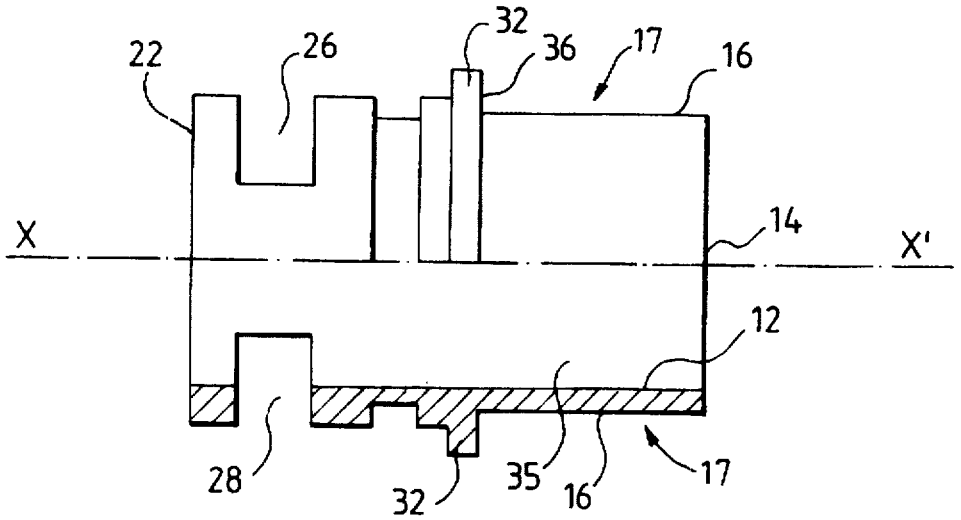

FIG. 4 shows an exemplary embodiment of a shaft 17 incorporated into a device for joining up sheathings according to the invention. The shaft has an external surface 16 and an internal surface 12. It is ended by two ends 14, 22. The first end 14 is the front end. The second end 22 is the rear end. The internal surface 12 is a cylindrical surface generated by revolution having the same diameter, in this example, throughout the length of the shaft. Except for two notches 26, 28 which shall be referred to further below, the external surface 16 of the shaft 17 also has a shape generated by revolution.

The example shown can be likened to the example of the prior art shown in FIG. 3 of the present application. Naturally, it may be the case that the shaft does not have a front part 35 housed in the chamber as shown for example in FIG. 2 of the above-mentioned patent. At best, it will have in this case a front part housed in the chamber and designed, together with the sector shells which shall be referred to further below, to center the shaft. The shaft could also have the shape shown in FIG. 4 of the above-mentioned patent.

In the preferred embodiment, the shaft has a front part 35 which, in the assembly of the device, is housed within the chamber 11. This front part 35 ends in a shoulder 32 forming a radial projection of the front part of the external surface 16. Unlike in the prior art described, this shoulder 32 is designed to be housed outside the chamber 11. The shoulder, on its front part, has a radial projecting surface 36. This surface takes the form of a ring whose internal diameter is that of the external diameter of the front part 35 of the shaft 17. The value of the external diameter of the shoulder is greater than or at least equal to the internal diameter of the rear end 6 of the chamber 11 according to the embodiment.

In a first embodiment, this shoulder is used as a means of contact between the chamber and the shaft. In this first embodiment, the external diameter of the shoulder is greater than the internal diameter of the rear end 6 of the chamber 11. In the assembled design, the surface 36 comes into contact with the surface 2 of the rear end of the chamber 11.

In a second embodiment, which is the preferred embodiment, the contact means are formed by sector shells, an exemplary embodiment of which shall be described with reference to FIG. 5. In this preferred embodiment, the front surface 36 of the shoulder 32 is supported on the sector shells. The sector shells are themselves supported on the surface 2 of the rear end 6 of the chamber 11. The value of this preferred mode, as explained further above, is that it enables the chamber 11 to be moved further back along the shaft. This valuable aspect therefore entails the assumption that the external diameter of the shoulder 32 is, in this case, equal at most, allowing for tolerances, to the diameter of the rear part of the chamber 11. Thus, in the preferred embodiment, the shoulder 32 may be inserted into the chamber 11 up to the bottom of the rear part 4. In this position, the front surface 36 of the shoulder 32 lies on the connection ring 1 between the front part 5 and the rear part 4 of the chamber 11. This configuration is the configuration in the course of undergoing assembly or repairs. If the front part 5 and rear part 4 have the same diameter, then the shaft 17 slides freely in the chamber 11.

Examples of sector shells 40 shall now be described with reference to FIG. 5. In the example shown, these are half-shells 40 each covering a 180° sector. The number of sector shells may vary. The essential point is that the shells should together cover a 360° sector.

Figure 5B:
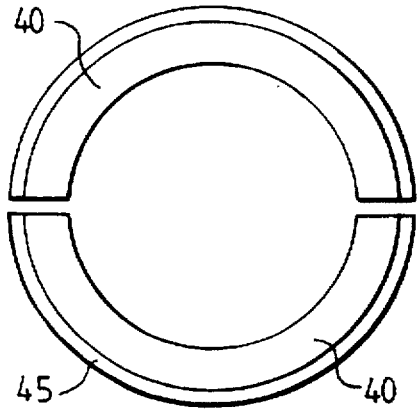
FIG. 5*b* shows an axial view from the front to the rear of these two half-shells.
Figure 5A:
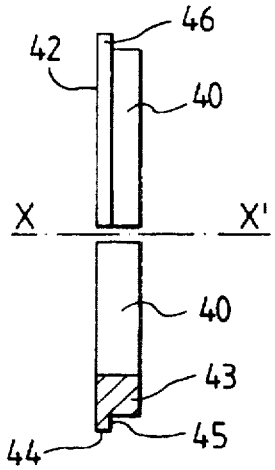
FIG. 5*a* shows a sectional half-view and a lateral half-view of two half-shells intended for the preferred embodiment to replace a contact shoulder of the shaft.

FIG. 5*a*, in its lower part, shows a sectional view along an axial plane of a half-shell and, in its upper part, shows a lateral view. FIG. 5*b* shows an exploded right-hand view of the two half-shells. The two half-shells 40 essentially take the form of two thick half-washers. The external diameter of the washer constituted by the joining of the shells is greater than the internal diameter of the rear end of the chamber 11. As a result, at least a part 46 of the front surface of each shell is supported in the assembly on the rear surface 2 of the chamber 11. The internal diameter of the washer formed by the joining of the shells is equal, allowing for tolerances, to the diameter of the external surface 16 of the shaft 17 which is immediately before the shoulder 32. In this embodiment, the shoulder 32, in the assembled device, is supported by its front surface 36 on at least a part of the rear surface 42 of the shells 40. In the preferred embodiment shown herein, the shells 40 are used, in addition to their electromagnetic imperviousness contact functions, to center the shaft. This is why, in this example, each shell 40 has a front part 43 and a rear part 44. The external diameter of the front part 43 is equal, allowing for tolerances, to the internal diameter of the rear end 6 of the chamber 11. This front part 43 is, in the assembled device, within the chamber 11. To facilitate the assembly of the shells 40, this front part could have a slightly truncated lateral surface, the part with the smallest diameter being located in front of the shell. The external diameter of the rear part 44 is also greater than the internal diameter of the rear end 6 of the chamber 11. The front parts 43 and 44 are connected to each other by a radial surface 45. In the assembled device, it is this surface 45 that forms at least a part of the contact surface 46 between the shells and the rear surface 2 of the rear end 6 of the chamber 11.

Figure 6:
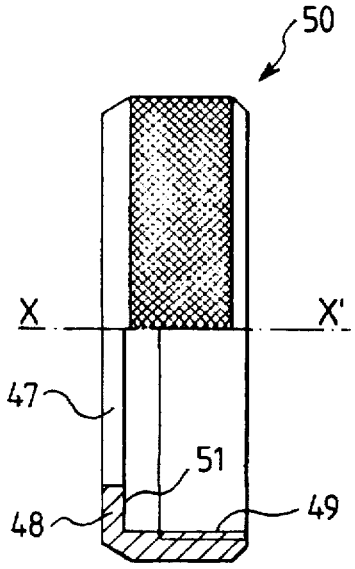

FIG. 6 gives a view, in its lower part, of a half-section, along an axial plane, of a nut 50 which, in the preferred embodiment or in its variant, enables the assembling of the shaft 17 and the chamber 11. The nut 50 has an internally tapped part 49 located in front of the nut and a rear partition 48 located behind the nut. The rear partition 48 is drilled with an aperture 47 centered on the axis XX'. The partition 48 has an internal supporting surface 51. The diameter of the aperture 47 enables the passage of the shaft part 17 located behind the shoulder 32. It is preferably equal, allowing for tolerances, to the diameter of the part of the shaft 17 located immediately behind this shoulder 32.

In the first embodiment, the nut 50 positions the front surface 36 of the shoulder 32 against the surface 2 of the rear end 6 of the chamber 11. It will be noted that, according to a small variant of this first embodiment, the shoulder 32, like the washer formed by the set of shells 40, may have a front part designed to center the shaft. This front part of the shoulder 32, like the front part 43 of the shells, then has a diameter that is equal, allowing for tolerances, to the internal diameter of the rear end 6 of the chamber 11.

In the preferred embodiment, the nut 50 positions the front surface 36 of the shoulder 32 against the rear surface 42 of the shells 40. The tapped part 49 of the nut 50 works together with the externally threaded part 3 of the chamber 11.

Figure 7B:
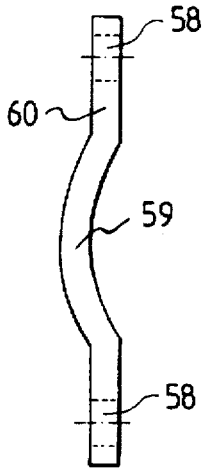
FIG. 7*b* shows a lateral view of the same clamping lug.
Figure 7A:
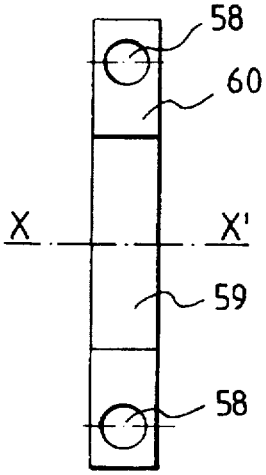
FIG. 7*a* shows a front view of a clamping lug to clamp the cable to the shaft.

Before describing the assembly of the preferred embodiment, a description shall be given here below with reference to FIG. 7 of the clamping lugs for the cable that get housed partially in the notches 26, 28 of the shaft 17. FIG. 7*a* gives a view of a lug of this kind perpendicular to the axial direction XX'. FIG. 7*b* shows a right-hand view of this same lug.

It has been seen further above that, according to one alternative embodiment, the shaft part 17 external to the chamber 11 may have two symmetrical notches 26, 28. These notches, together with two lugs 60, are used to hold the cable tightly to the shaft. Each lug 60 takes the form of a flat rod with a concavity 59 formed in its middle. The width of each rod measured parallel to the axis XX' is at most equal to the length of the notches 26, 28 measured along this axis. The lugs 60 are provided with holes 58 on each side of the central concavity 59. These holes 58, along with bolts not shown, constitute means to fix the cable tightly to the shaft 59.

These bolts make it possible, by reducing the distance between the concavities 59 and the lugs 60, to grip the cable tightly. The concavities 59 are, in the assembled device, at least partially housed in the notches 26, 28 of the shaft. This holds them fixed in the axial direction.

The assembly of the preferred embodiment shall now be described with reference to FIG. 8. In this upper part, this figure gives a lateral half-view and, in its lower part, a half section by an axial plane of the preferred embodiment of a device assembled according to the invention.

The device has a chamber 11 as described with reference to FIG. 3 with, at its first end, tightly sealed connection means 10, herein in the form of a nut 10.

The device also has the shaft 17. The electromagnetically impervious joining between the shaft 17 and the chamber 11 is provided by means of the nut 50 and the shells 40.

The shells 40 also provide for the centering of the shaft 17 by their internal lateral surface which is in contact with the part of the external lateral surface 16 of the shaft located immediately before the shoulder 32 and by the external lateral surface of their front part 43 which is in contact with the internal lateral surface of the rear end 6 (FIG. 3) of the chamber 11. The connection surface 45 between the front part 43 and the rear part 44 of the shells is supported on the surface 2 of the rear end 6 of the chamber 11 (FIG. 3).

The shoulder 32 of the shaft 17 is supported on the rear surface 42 of the sector shells 40.

The nut 50 which has been connected to the thread 3 of the chamber provides, by being supported on the rear surface of the shoulder 32, for the axial holding of the assembly. Naturally, this axial holding could be provided by any other known means.

When the nut 50 is loosened, the shells 40 may be moved away radially and the shoulder 32 may then slide in the chamber 11 until it abuts the surface 1 joining the front part 5 and the rear part 4 of the chamber 11, or totally freely if this connection is not necessary.

The concave parts 59 of the lugs 60 grip the cable tightly through the notches 26, 28 of the shaft 17.

FIG. 8 shows a cable 29 inserted into the device assembled according to the invention. At the front lead-out of the shaft 17, the cables 41 forming the strand have been stripped of their individual sheathings and these sheathings as well as, possibly, an external comprehensive sheath 31, are folded down in a known way on the front part 35 of the shaft. The folded-down part 37 is held, for example, by a fastening ring 39 to the front part 35. If there is excess sheathing, it may be connected to the rear of the shaft. This embodiment prevents bulkiness in the chamber 11 whose diameter may then be reduced.

The difference between the internal diameter of the shaft and the internal diameter of the chamber results, in this case, from the need for the internal diameter of the shaft 17 to enable the passage of the strand and for the internal diameter of the chamber 11 to enable the housing of the folded-down part 37, and in this case, the housing of the fastening ring 39.

What is claimed is:

1. A device for sheathing ends of a strand of sheathed cables, where said ends are inserted into a sheathing casing, the device comprising:

a chamber having an axis and two ends along the axis including a front end close to the ends of the cables and a rear end at a distance from the ends of the cables, the chamber having an internal surface which demarcates an internal volume of the chamber;

a single shaft having the same axis as said chamber and two ends along said axis including a front end close to the ends of the cables and a rear end at a distance from the ends of the cables, said shaft having an internal surface and an external surface, with the internal surface of the shaft demarcating a volume for housing part of the strand;

a means of contact between the shaft and the chamber for ensuring electromagnetic imperviousness at the rear end of the chamber, said means of contact being in continuous electrical contact throughout a periphery of the shaft and also in continuous electrical contact throughout a periphery of the chamber, the external perimeter of said means of contact being greater than an internal perimeter of the chamber in a plane perpendicular to said axis.

2. A device according to claim 1, wherein at least one cross-section of the chamber located close to the front end has an internal diameter smaller than that of a cross-section of the internal surface located close to the rear end of the chamber.

3. A device according to claim 1, wherein the rear end of said chamber has a cylindrical shape generated by revolution.

4. A device according to claim 1, wherein the chamber is provided with an external thread.

5. A device according to claim 1, wherein the shaft is provided with a shoulder projecting radially to the external surface of the shaft, this shoulder constituting the means of contact between the chamber and the shaft.

6. A device according to claim 5, wherein the shaft, at least at the shoulder, has a shape generated by revolution around the axis.

7. A device according to claim 5, wherein a part of the shaft located outside the chamber comprises two notches enabling housing, at least partially, of the cable fastening lugs.

8. A device according to claim 1, wherein the contact means comprise sector shells together having substantially the shape of a flat washer, having a front surface, a rear surface, an internal lateral surface and an external lateral surface, the internal lateral surface of the washer thus formed being in electrical contact with the external surface of the shaft, at least a part of the front surface being supported on the rear surface of the rear end of the chamber.

9. A device according to claim 8, wherein the washer formed by the set of the shells has a front part, of which at least a part of the external lateral surface is in contact with the internal lateral surface of the rear end of the chamber to provide for a positioning of the shaft with respect to the chamber.

10. A device according to any of the claims 5 to 9, wherein the shaft and the chamber are held in a joined state by means that exert a pressure directed frontwards on a rear part of the shoulder of the shaft.

11. A device according to claim 8, wherein the means that enable the pressure to be exerted consist of a nut screwed on to the threaded part of the chamber.

12. A device according to claim 7, wherein the device further comprises clamping lugs which, in cooperation with notches of the shaft, enable the holding of a cable strand.

* * * * *